US006485133B1

(12) United States Patent
Teramae et al.

(10) Patent No.: US 6,485,133 B1
(45) Date of Patent: Nov. 26, 2002

(54) ACTUATOR DEVICE AND INK JET RECORDING APPARATUS

(75) Inventors: Hirofumi Teramae; Satoru Hosono, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/494,420

(22) Filed: Jan. 31, 2000

(30) Foreign Application Priority Data

Jan. 29, 1999 (JP) ..... 11-023310
Nov. 25, 1999 (JP) ..... 11-334733
Jan. 20, 2000 (JP) ..... 2000-012300

(51) Int. Cl.[7] ..... B41J 2/045

(52) U.S. Cl. ..... 347/68; 347/68; 347/69; 347/70; 347/71; 347/72

(58) Field of Search ..... 347/68, 70, 71, 347/72, 10, 11, 69

(56) References Cited

U.S. PATENT DOCUMENTS 4,728,969 A * 3/1988 Le et al. ..... 347/68
5,124,716 A * 6/1992 Roy et al. ..... 347/70
6,149,258 A * 11/2000 Kimura ..... 347/70
6,257,688 B1 * 7/2001 Kubo ..... 347/11

FOREIGN PATENT DOCUMENTS

EP 0 827 838 A2 3/1998 ..... B41J/2/21
EP 0 864 425 A1 9/1998 ..... B41J/2/045
JP 09-052360 2/1997
JP 10-24570 1/1998 ..... B41J/2/045
JP 10-202884 8/1998 ..... B41J/2/12
JP 10-235859 9/1998 ..... B41J/2/045
JP 10-329313 12/1998
JP 11-020203 1/1999
JP 2940542 6/1999 ..... B41J/2/205
WO 98/46432 10/1998 ..... B41J/2/205

* cited by examiner

*Primary Examiner*—John Barlow
*Assistant Examiner*—Ly T. Tran
(74) *Attorney, Agent, or Firm*—Sughrue Mion, PLLC

(57) ABSTRACT

A drive signal for driving a ink jet recording head as an actuator device indudes an expansion potential for deforming the piezoelectric actuator so as to expand the pressure generating chamber, a contraction potential for deforming the piezoelectric actuator so as to contract the pressure generating chamber, an ejection element for varying a potential of the drive signal from the expansion potential to the contraction potential to eject the ink drop from the nozzle, and a contraction holding element for holding the second potential to keep the contracted state of the pressure generating chamber. A duration of the ejection element is determined so as to match with a natural period of the piezoelectric actuator. A duration of the contraction holding element is determined such that a resulting value by adding the duration of the ejection element and the duration of the contraction holding element is matched with a natural period of the pressure generating chamber.

16 Claims, 9 Drawing Sheets

CARRIAGE MECHANISM
PAPER FEED MECHANISM
24
23
8
2
1
OSCILLATOR
7
10
I/F
ROM
5
RAM
4
RECEPTION BUFFER
INTERMEDIATE BUFFER
OUTPUT BUFFER
4A
4B
4C
DRIVE SIGNAL GENERATOR
9
CONTROL SECTION
6
I/F
3
201, 202
COM
LAT
SI
CK
PIEZOELECTRIC VIBRATOR
40
SWITCHING CIRCUIT
63
LEVEL SHIFTER
62
LATCHING CIRCUIT
61
SHIFT REGISTER
60

COM
DRIVE SIGNAL GENERATING SECTION
13
9
ROM
11
EEPROM
12

FIG. 9A

| ID NUMBER | 0 | 1 | 2 | 3 | 4 | 5 | 6 | 7 | 8 | 9 | A | B |
|---|---|---|---|---|---|---|---|---|---|---|---|---|
| pwd1 | 4 | 3.5 | 3.6 | 3.7 | 3.7 | 3.9 | 4 | 4.1 | 4.2 | 4.3 | 4.4 | 4.5 |

FIG. 9B

| ID NUMBER | 0 | 1 | 2 | 3 | 4 | 5 | 6 | 7 | 8 | 9 | A | B |
|---|---|---|---|---|---|---|---|---|---|---|---|---|
| pwh2 | 4.5 | 3.1 | 3.3 | 3.5 | 3.7 | 3.9 | 4.1 | 4.3 | 4.5 | 4.7 | 4.9 | 5.1 |
| ID NUMBER | C | D | E | F | 10 | | | | | | | |
| pwh2 | 5.3 | 5.5 | 5.7 | 5.9 | 6.1 | | | | | | | |

ACTUATOR DEVICE AND INK JET RECORDING APPARATUS

BACKGROUND OF THE INVENTION

This invention relates to an actuator device operated by a drive signal, an ink jet recording apparatus typified by an ink jet printer and a recording medium in which a program for driving the same is stored.

An actuator unit operated by a drive signal is utilized in various purposes. For example, as an ink jet recording head, which is one embodiment of such an actuator, used with an ink jet recording apparatus such as an ink jet printer, for example, an ink jet recording head is known wherein a piezoelectric actuator is deformed, thereby expanding or contracting a cavity (pressure generating chamber) for jetting an ink drop through an nozzle orifice.

A recording head of this kind has an extremely high resolution, for example, 720 dpi or 1440 dpi and thus requires very high work accuracy in $\mu$m units.

Variations in jetting characteristics of ink drops for each recording head occur because of a shift from the reference length of the free end portion of a piezoelectric actuator caused by an attachment error, work accuracy of the piezoelectric actuator and cavity, and the like. Then, an optimum drive voltage is set for each recording head for correcting variations for making uniform jetting characteristics of ink drops, whereby the recording head quality is stabilized and the yield of the recording heads is improved.

There is disclosed a drive signal generating device for driving an ink jet recording head as one embodiment of the actuator in Japanese Patent No. 2940542. In the device, a drive signal a waveform of which is varied in accordance with ambient temperature is programmably generated to correct variations of the ink drop jetting characteristics of the respective recording heads.

SUMMARY OF THE INVENTION

The present invention is provided in view of the above circumstance and it is therefore an object of the present invention is to provide an actuator unit using a suitable drive signal selected flexibly even if the actuator unit has inherent variations of characteristics thereof.

Another object of the present invention is to provide an ink jet recording apparatus incorporating the actuator, the yield of which can be improved.

In order to achieve the above objects, there is provided an ink jet recording apparatus comprising:

a recording head including a piezoelectric actuator for varying the volume of a pressure generating chamber by the deformation thereof to eject an ink drop from a nozzle communicating with the pressure generating chamber;

a drive signal generator for generating a drive signal including:

an expansion potential for deforming the piezoelectric actuator so as to expand the pressure generating chamber;

a contraction potential for deforming the piezoelectric actuator so as to contract the pressure generating chamber;

an ejection element for varying a potential of the drive signal from the expansion potential to the contraction potential to eject the ink drop from the nozzle; and a contraction holding element for holding the contraction potential to keep the contracted state of the pressure generating chamber, an ejection period information storage for storing a plurality values of a duration of the ejection element; and a contraction holding period information storage for storing a plurality values of a duration of the contraction holding element, wherein the drive signal generator selects one duration of the ejection element and one duration of the contraction holding element respectively from the ejection period information storage and the contraction holding information storage such that the duration of the ejection element is matched with a natural period of the piezoelectric actuator, and a resulting value by adding the duration of the ejection element and the duration of the contraction holding element is matched with a natural period of the pressure generating chamber.

Preferably, the apparatus further comprises:

an ejection period identifier storage for storing ejection period identifiers each of which is associated with the respective values stored in the ejection period information storage; and a contraction holding period identifier storage for storing contraction holding period identifiers each of which is associated with the respective values stored in the contraction holding period information storage.

Here, the drive signal generator refers to the ejection period identifier and the contraction holding period identifier to determine the application periods of the ejection element and the contraction holding element.

Preferably, the drive signal includes a variable intermediate potential which is between the expansion potential and the contraction potential, and a damping element for varying the potential of the drive signal from the contraction potential to the intermediate potential for restoring the contracted pressure generating chamber to an initial state. The drive signal generator determines a duration of the damping element so as to match with the natural period of the piezoelectric actuator.

Preferably, the apparatus further comprises:

intermediate potential information storage means for storing a plurality values of the intermediate potential.

Here, the drive signal generator selects one potential value from the intermediate potential information storage means in accordance with jetting amount of the ink drop.

Preferably, the apparatus further comprises:

an intermediate potential identifier storage for storing intermediate potential identifiers each of which is associated with the respective values stored in the intermediate potential information storage.

Here, the drive signal generator refers to the intermediate potential identifier to determine the value of the intermediate potential.

Preferably, the drive signal is so arranged as to eject a plurality of ink drops having the same weight successively within the same driving period.

Preferably, the respective potentials and the respective elements in the drive signal is programmably defined.

According to the present invention, there is also provided an ink jet recording apparatus comprising:

a recording head including a piezoelectric actuator for varying the volume of a pressure generating chamber by the deformation thereof to eject an ink drop from a nozzle communicating with the pressure generating chamber; and a drive signal generator for generating a drive signal including:

an expansion potential for deforming the piezoelectric actuator so as to expand the pressure generating chamber;

a contraction potential for deforming the piezoelectric actuator so as to contract the pressure generating chamber;

an intermediate potential which is between the expansion potential and the contraction potential;

an ejection element for varying a potential of the drive signal from the expansion potential to the contraction potential to eject the ink drop from the nozzle;

a contraction holding element for holding the contraction potential to keep the contracted state of the pressure generating chamber; and a damping element for varying the potential of the drive signal from the contraction potential to the intermediate potential for restoring the contracted pressure generating chamber to an initial state; and a characteristic information storage for storing characteristic information of the recording head which is referred by the drive signal generator and reflected to at least one of the expansion potential, the contraction potential, the intermediate potential, the ejection element, the contraction holding element and the damping element to generate the drive signal.

Preferably, the characteristic information includes at least one of a natural period of the piezoelectric actuator, a natural period of the pressure generating chamber and a natural period of meniscus of ink in the nozzle.

Preferably, the respective potentials and the respective elements in the drive signal is programmably defined.

According to the present invention, there is also provided an actuator device comprising:

an actuator;

a drive signal generator for generating a drive signal driving the actuator and including a programmable waveform element; and a characteristic information storage for storing characteristic information of the actuator which is referred by the drive signal generator and reflected to the waveform element to generate the drive signal.

Preferably, the drive signal is composed of a plurality of waveform elements, and the characteristic information is reflected to at least one of the waveform elements.

Preferably, the characteristic information includes a natural period of contituent elements of the actuator device.

Preferably, the characteristic information includes a natural period of contituent elements of the actuator.

Preferably, the characteristic information includes a natural period of the actuator.

According to the present invention, there is also provided a recording medium for storing a program for driving the actuator device as described above, which is executed by a computer system including at least one computer.

According to the present invention, there is also provided a recording medium for storing a program for driving the ink jet recording apparatus as described above, which is executed by a computer system including at least one computer.

BRIEF DESCRIPTION OF THE DRAWINGS

In the accompanying drawings:

FIG. 9A is a table describing relationship between ID numbers and application periods of the ejection element of the drive signal shown in FIG. 7; and FIG. 9B is a table describing relationship between ID numbers and application periods of the second holding element of the drive signal shown in FIG. 7.

DETAILED DESCRIPTION OF THE PREFERRED EMBODIMENTS

Figures 1A, 1B:
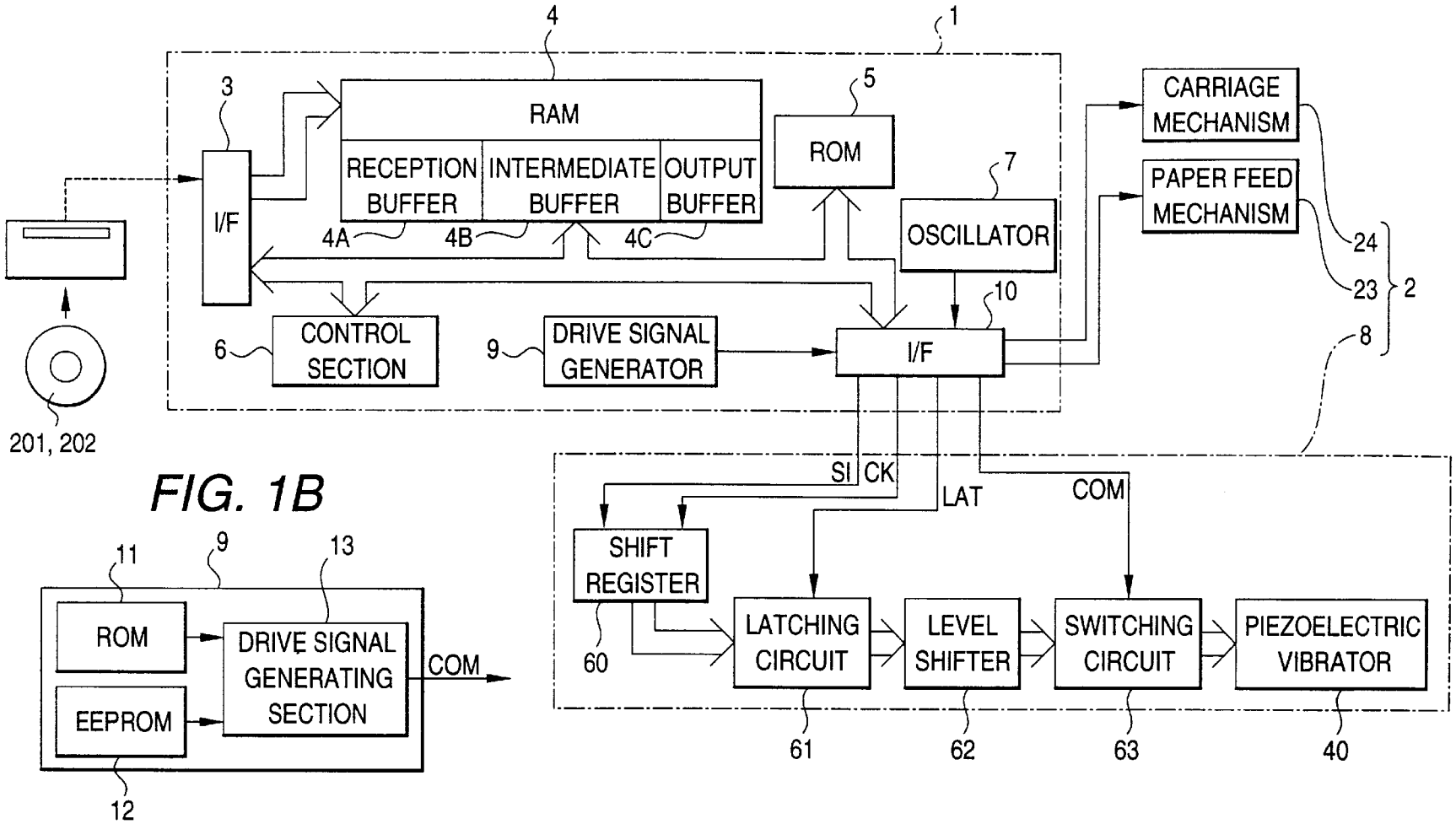
FIG. 1A is a block diagram showing the configuration of an ink jet printer.
FIG. 1B is a block diagram of the drive signal generator of FIG. 1A.

Referring now to the accompanying drawings, there is shown an embodiment of the invention by taking an ink jet printer (simply, printer) of a representative ink jet recording apparatus as an example. As shown in FIG. 1A, the printer is roughly made up of a printer controller 1 and a print engine 2.

The printer controller 1 comprises an external interface 3 (external I/F 3), RAM (random access memory) 4 for temporarily storing various pieces of data, control ROM (read-only memory) 5 for storing a control program, etc., a control section 6 containing a CPU (central processing unit), etc., an oscillator 7 for generating a clock signal, a drive signal generating section 9 for generating a drive signal (COM) supplied to a recording head 8, and an internal interface 10 (internal I/F 10) for transmitting the drive signal and dot pattern data (bit map data) expanded based on print data and the like to the print engine 2.

The external I/F 3 receives print data made up of character code, a graphic function, image data, etc., for example, from a host computer (not shown), etc. A busy signal (BUSY) and an acknowledge signal (ACK) are output through the external I/F 3 to the host computer, etc.

The RAM 4 functions as a reception buffer 4A, an intermediate buffer 4B, an output buffer 4C, and work memory (not shown). The reception buffer 4A temporarily stores the print data received through the external I/F 3, the intermediate buffer 4B stores intermediate code data provided by the control section 6, and the output buffer 4C stores dot pattern data. The dot pattern data is print data provided by decoding (translating) gradation data.

The control ROM 5 stores font data, graphic functions, etc., in addition to the control program (control routine) for performing various types of data processing.

The control section 6 performs various types of control. In addition, it reads the print data in the reception buffer 4A and stores the intermediate code data provided by converting the print data in the intermediate buffer 4B. Also, the control section 6 analyzes the intermediate code data read from the intermediate buffer 4B, references the font data, graphic function, etc., stored in the control ROM 5, and expands the intermediate code data into dot pattern data. After performing necessary decoration processing, the control section 6 stores the dot pattern data in the output buffer 4C.

If one line of the dot pattern data that can be recorded by one main scanning of the recording head 8 is provided, it is output from the output buffer 4C through the internal I/F 10 to the recording head 8 in sequence. When one line of the dot pattern data is output from the output buffer, the already expanded intermediate code data is erased from the intermediate buffer and the next intermediate code data is expanded.

The drive signal generator 9 comprises ROM 11 storing waveform pattern information forming drive signals and the like, EEPROM 12 storing the ID number (described later) set for each recording head 8, and a drive signal generating section 13 for making a reference to the waveform pattern information stored in the ROM 11 based on the ID number stored in the EEPROM 12 and generating a sequence of drive signals fitted to the recording head, as shown in FIG. 1B.

Figure 8:
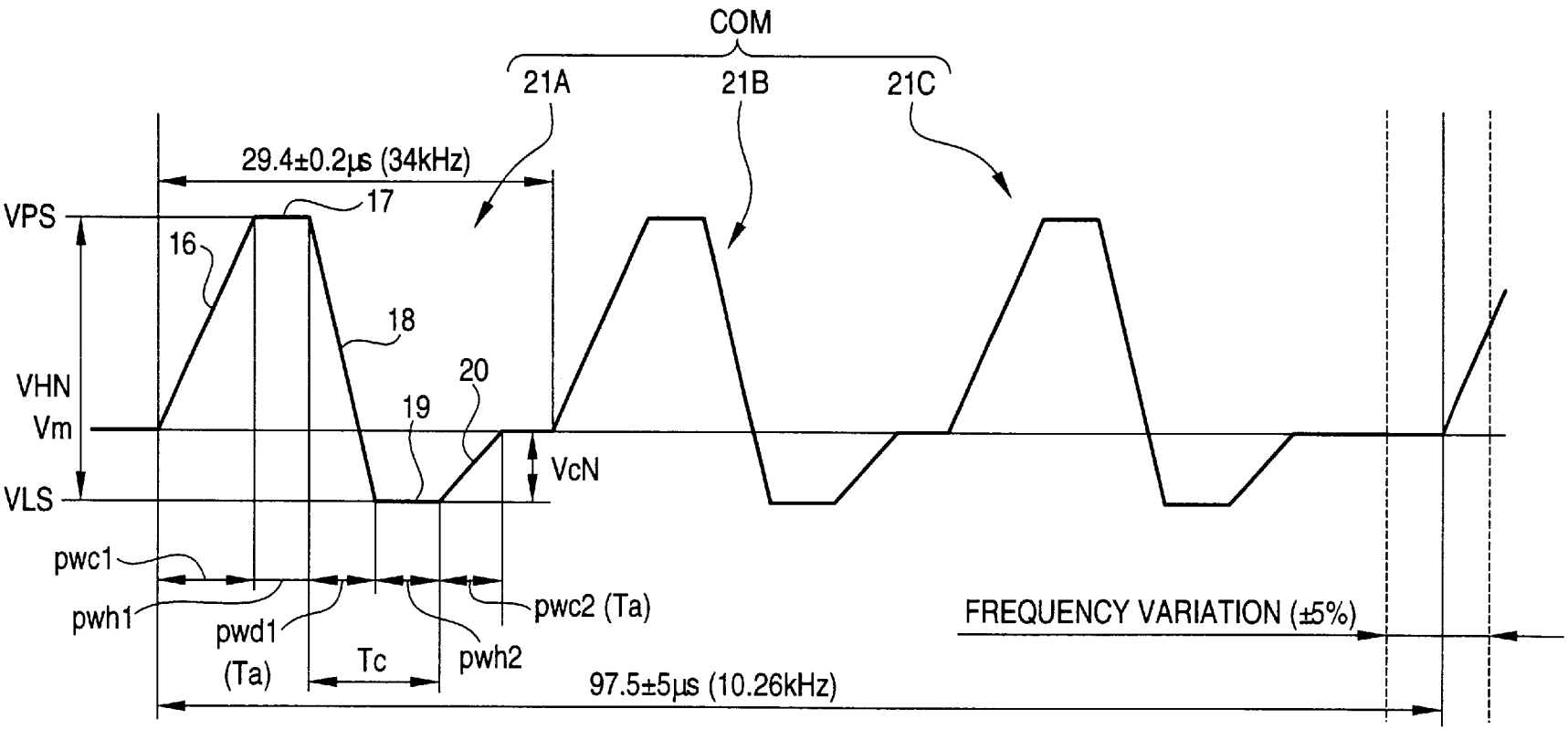
FIG. 8 is a diagram showing a detailed waveform of the drive signal shown in FIG. 7.

For example, as shown in FIG. 8, the drive signal (COM) generated by the drive signal generating section 13 is a signal comprising three pulse signals 21 (21A, 21B, and 21C) connected in series each consisting of an expansion element 16 for increasing potential at a constant voltage gradient from intermediate potential Vm to expansion potential VPS, a first holding element 17 for holding the expansion potential VPS, an ejection element 18 for decreasing potential at a constant voltage gradient from the expansion potential VPS to contraction potential VLS, a second holding element (contraction holding element) 19 for holding the contraction potential VLS, and a damping element 20 for increasing potential at a constant voltage gradient from the contraction potential VLS to the intermediate potential Vm.

The ROM 11 functions as ejection period information storage means, contraction holding period information storage means, damping period information storage means, damping voltage information storage means, and drive voltage information storage means in the present invention, and stores information of parameters consisting of duration of the ejection element 18, pwd1 (ejection period information), duration of the second holding element 19, pwh2 (contraction holding period information), duration of the damping element 20, pwc2 (damping period information), potential difference between the contraction potential VLS and the intermediate potential Vm, VcN (damping voltage information), and drive voltage VHN (drive voltage information). Further, the information of each parameter consists of information of a plurality of types of application periods and potential differences and the numerical information pieces are retained in a one-to-one correspondence with ID numbers, namely, in a state in which one information piece is assigned one ID number.

The EEPROM 12 functions as ejection period identifier storage means, contraction holding period identifier storage means, damping period identifier storage means, damping voltage identifier storage means, and drive voltage identifier storage means in the present invention, and stores setup values of the ID number for the ejection element 18 (ejection period identifier), the ID number for the second holding element 19 (contraction holding period identifier), the ID number for the damping element 20 (damping period identifier), the ID number for the potential difference VcN (damping voltage identifier), and the ID number for the drive voltage VHN (drive voltage identifier) for each recording head 8.

The drive signal generating section 13 functions as drive signal generator in the present invention and makes a reference to the ID number for the ejection element 18, the ID number for the second holding element 19, etc., stored in the EEPROM 11 and generates the drive signals specified on the ID numbers.

The information stored in the ROM 11 and the EEPROM 12 and the drive signals will be discussed later in detail.

The print engine 2 comprises a paper feed mechanism 23, a carriage mechanism 24, and the above-mentioned recording head 8.

Figure 2:
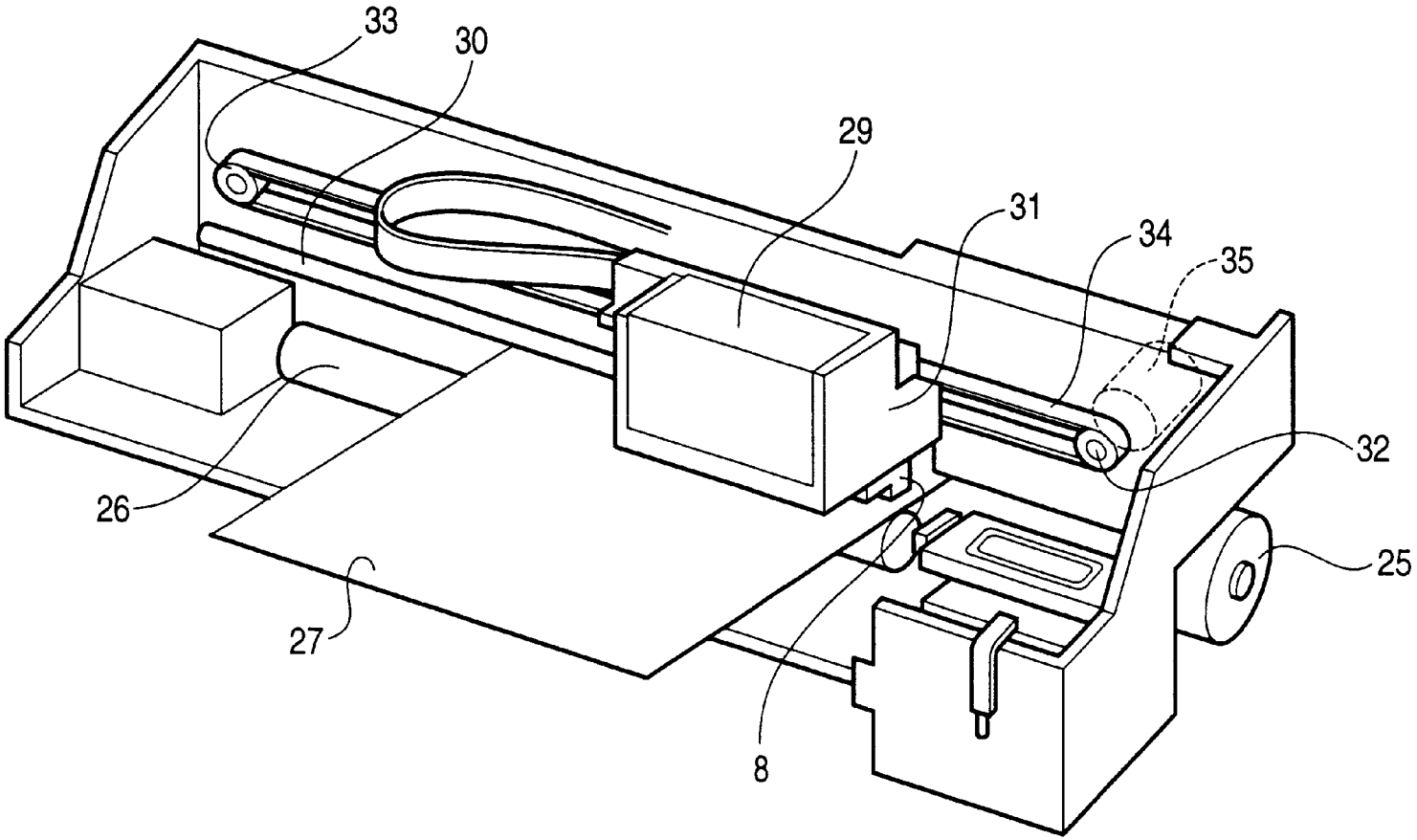
FIG. 2 is a perspective view showing the internal mechanism of the ink jet printer.

As shown in FIG. 2, the paper feed mechanism 23 is made up of a paper feed motor 25, a paper feed roller 26, etc., and feeds record paper (a kind of record medium) 27 in sequence in association with the record operation of the recording head 8. That is, the paper feed mechanism 23 moves the record paper 27 in the record paper feed direction, which is a subscanning direction.

The carriage mechanism 24 comprises a carriage 31 on which the recording head 8 and an ink cartridge 29 can be mounted, the carriage 31 being attached to a guide member 30 movably, a timing belt 34 placed on a drive pulley 32 and a driven pulley 33 and connected to the carriage 31, and a pulse motor 35 for rotating the drive pulley 32.

In the carriage mechanism 24, the carriage 31 is reciprocated along the width direction of the record paper 27 by the operation of the pulse motor 35. That is, the recording head 8 mounted on the carriage 31 is moved along the main scanning direction.

Figure 3:
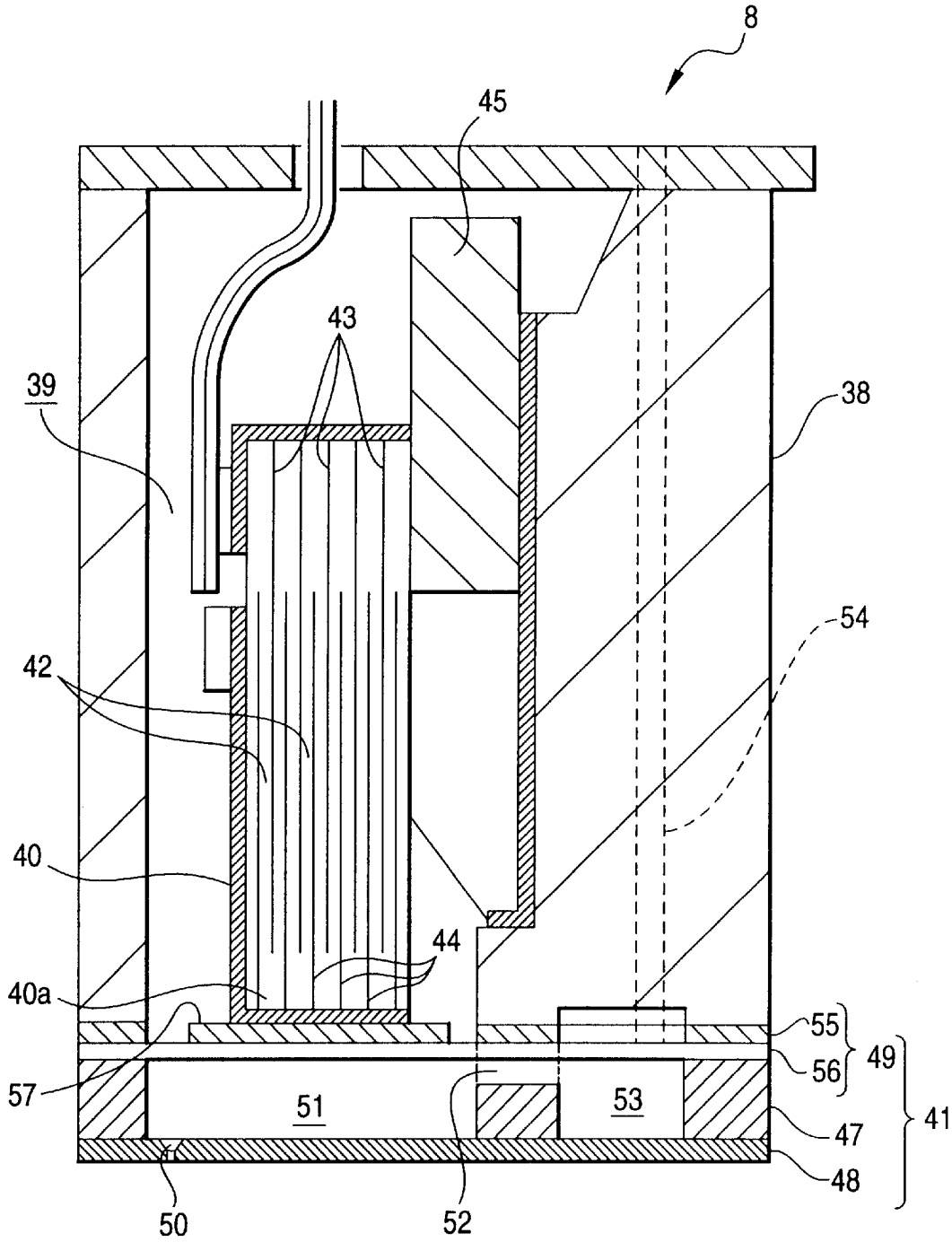
FIG. 3 is a sectional view showing the structure of a recording head.

Next, the recording head 8 will be discussed. To form the recording head 8 shown in FIG. 3, a piezoelectric actuator 40 shaped like comb teeth is inserted into a chamber 39 of a case 38 shaped like a plastic box, for example, through one opening, a tip end 40*a* shaped like comb teeth is made to face an opposite opening, a channel unit 41 is joined to the surface (bottom face) of the case 38 on the opening side, and the tip end 40*a* is abutted against and fixed to a predetermined part of the channel unit 41.

The piezoelectric actuator 40 comprises a plate-like vibration plate comprising an alternating pattern of common internal electrodes 43 and discrete internal electrodes 44 deposited on each other with a piezoelectric body 42 in between, the vibration plate being cut like comb teeth corresponding to the dot formation density. The base end side portion is joined to a fixation substrate 45 so as to become a cantilever stage and the fixation substrate 45 is joined to a wall of the storage chamber 39. A potential difference is given between the common internal electrode 43 and the discrete internal electrode 44, whereby the free end portion of each piezoelectric actuator 40, namely, the portion projecting to the outside from the overlapping end with the fixation substrate 45 is expanded or contracted in the length direction of the actuator orthogonal to the deposition direction.

The channel unit 41 comprises a nozzle plate 48 and an elastic plate 49 deposited on both sides with a channel formation plate 47 between.

The channel formation plate 47 is a plate member formed with a plurality of cavities (pressure generating chambers) 51 communicating with a plurality of nozzle orifices 50 made in the nozzle plate 48 and partitioned by diaphragms and an elongated common ink reservoir 53 with which a plurality of ink supply ports 52 each communicating with at least one end of each cavity 51 communicate. In the embodiment, the elongated common ink reservoir 53 is formed by etching a silicon wafer, the cavities 51 are formed matching the pitches of the nozzle orifices 50 along the length direction of the common ink reservoir 53, and the groove-like ink supply ports 52 are formed between the cavities 51 and the common ink reservoir 53. The ink supply port 52 is connected to one end of the cavity 51 and the nozzle orifice 50 is positioned in the proximity of the end part on the opposite side to the ink supply port 52.

The common ink reservoir 53 is a chamber for supplying ink stored in the ink cartridge 29 to the cavities 51 and an ink supply passage 54 communicates almost at the center in the length direction.

The elastic plate 49 is deposited on an opposite face of the channel formation plate 47 positioned on the opposite side to the nozzle plate 48 and is of a double structure comprising a polymer film of PPS, etc., laminated as an elastic film 56 on a stainless steel plate 55. The stainless steel plate 55 of the portion corresponding to the cavity 51 is etched to form an island portion 57 for abutting and fixing the piezoelectric actuator 40.

In the described recording head 8, the piezoelectric actuator 40 is expanded in the length direction of the actuator, whereby the island portion 57 is pressed against the nozzle plate 48, the elastic film 56 surrounding the island portion 57 becomes deformed, and the cavity 51 is contracted. If the piezoelectric actuator 40 is contracted in the length direction of the actuator, the cavity 51 is expanded due to elasticity of the elastic film 56. Expansion and contraction of the cavity 51 are controlled, whereby an ink drop is jetted through the nozzle orifice 50.

Figure 4:
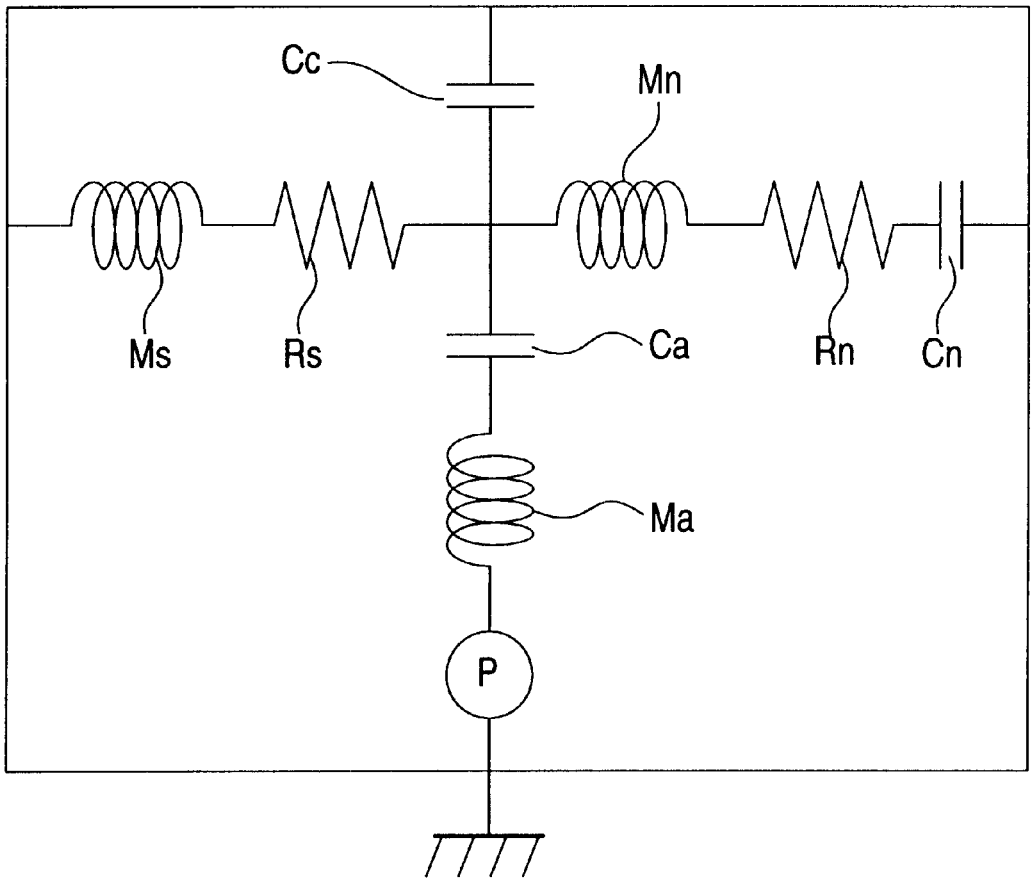
FIG. 4 is a diagram showing an equivalent circuit of a vibration system of the recording head.

A vibration system in the recording head 8 can be represented by an equivalent circuit shown in FIG. 4. Here, symbol M denotes inertance which is the mass of a medium per unit length [$Kg/m^4$], symbol Ma denotes inertance of the piezoelectric actuator 40, symbol Mn denotes inertance of the nozzle orifice 50, and symbol Ms denotes inertance of the ink supply port 52. Symbol R denotes resistance of the internal loss of a medium [$N \cdot s/m^5$], symbol Rn denotes resistance in the nozzle orifice 50, and symbol Rs denotes resistance in the ink supply port 52. Symbol C denotes compliance of volume change per unit pressure [$m^5/N$], symbol Cc denotes compliance of the cavity (pressure generating chamber) 51, symbol Ca denotes compliance of the piezoelectric actuator 40, and symbol Cn denotes compliance of the nozzle orifice 50. Symbol P denotes pressure generated with time by the piezoelectric actuator 40, in other words, equivalent pressure into which voltage pulses applied to the piezoelectric actuator 40 are converted.

Figure 5A:
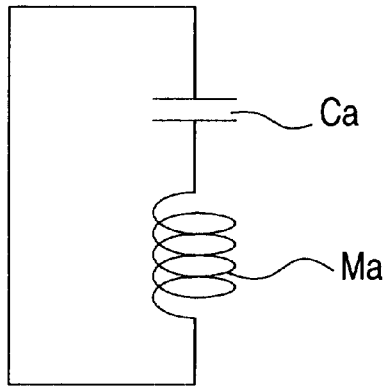
FIG. 5A is a diagram showing an equivalent circuit of a piezoelectric actuator system.

An equivalent circuit of the piezoelectric actuator system can be represented as in FIG. 5A from which it is known that natural period Ta of the piezoelectric actuator 40 can be calculated according to expression (1).

$$Ta=2\pi\sqrt{Ma \cdot Ca} \tag{1}$$

The natural period Ta calculated based on the expression (1), namely, theoretical value is about 4 $\mu$sec in the recording head 8 of the embodiment.

Figure 5B:
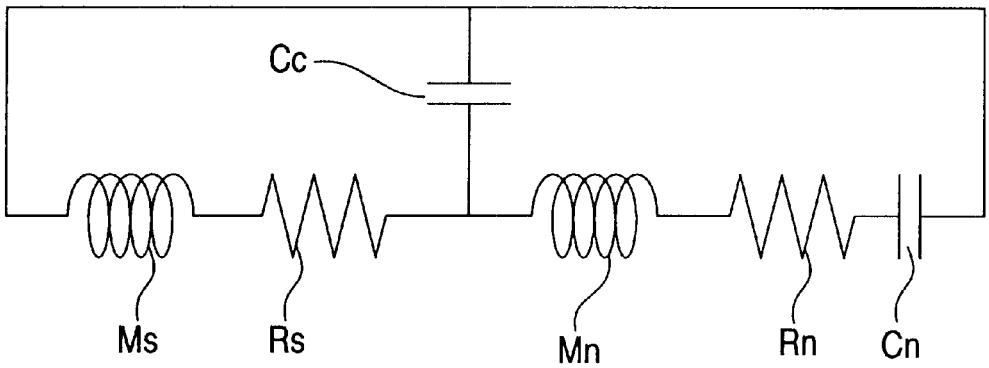
FIG. 5B is a diagram showing an equivalent circuit concerning ink in a cavity.

Likewise, an equivalent circuit concerning ink in the cavity 51 can be represented as in FIG. 5B from which it is known that natural period Tc of the cavity 51 can be calculated according to expression (2).

$$Tc = 2\pi\sqrt{\frac{Mn \cdot Ms}{Mn + Ms}Cc} \tag{2}$$

The natural period Tc calculated based on the expression (2), namely, theoretical value is about 8.5 $\mu$sec in the recording head 8 of the embodiment.

Figure 5C:
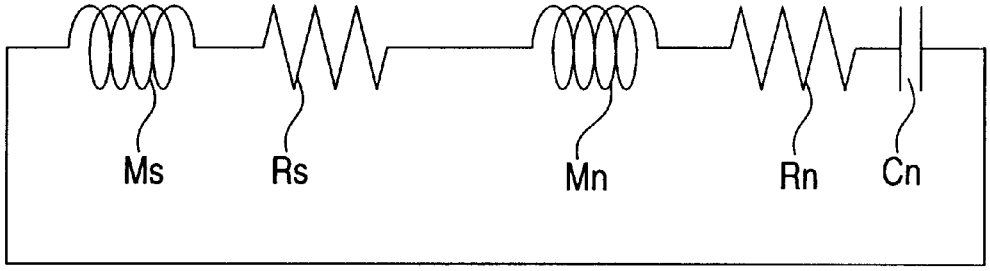
FIG. 5C is a diagram showing an equivalent circuit concerning a meniscus on a nozzle orifice.

Further, an equivalent circuit concerning a meniscus of the nozzle orifice 50 can be represented as in FIG. 5C from which it is known that natural period Tm of the meniscus can be calculated according to expression (3).

$$Tm=2\pi\sqrt{(Mn+Ms)Cc} \tag{3}$$

The meniscus mentioned here refers to a free surface of ink exposed on the nozzle orifice 50.

In the recording head 8 of the embodiment, the relation of Ta<Tc<Tm holds and the natural period Tm of the meniscus becomes about 10 times the natural period Tc of the cavity 51.

Next, the electric configuration of the recording head 8 and control for jetting ink drops will be discussed.

As shown in FIG. 1A, the recording head 8 comprises a shift register 60, a latching circuit 61, a level shifter 62, a switching circuit 63, the above-described piezoelectric actuator 40, etc. Further, as shown in FIG. 6, the shift register 60, the latching circuit 61, the level shifter 62, the switching circuit 63, and the piezoelectric actuator 40 consist of shift register elements 60A to 60N, latch elements 61A to 61N, level shifter elements 62A to 62N, switch elements 63A to 63N, and piezoelectric actuators 40A to 40N, respectively, provided in a one-to-one correspondence with the nozzle orifices 50 of the recording head 8.

Figure 6:
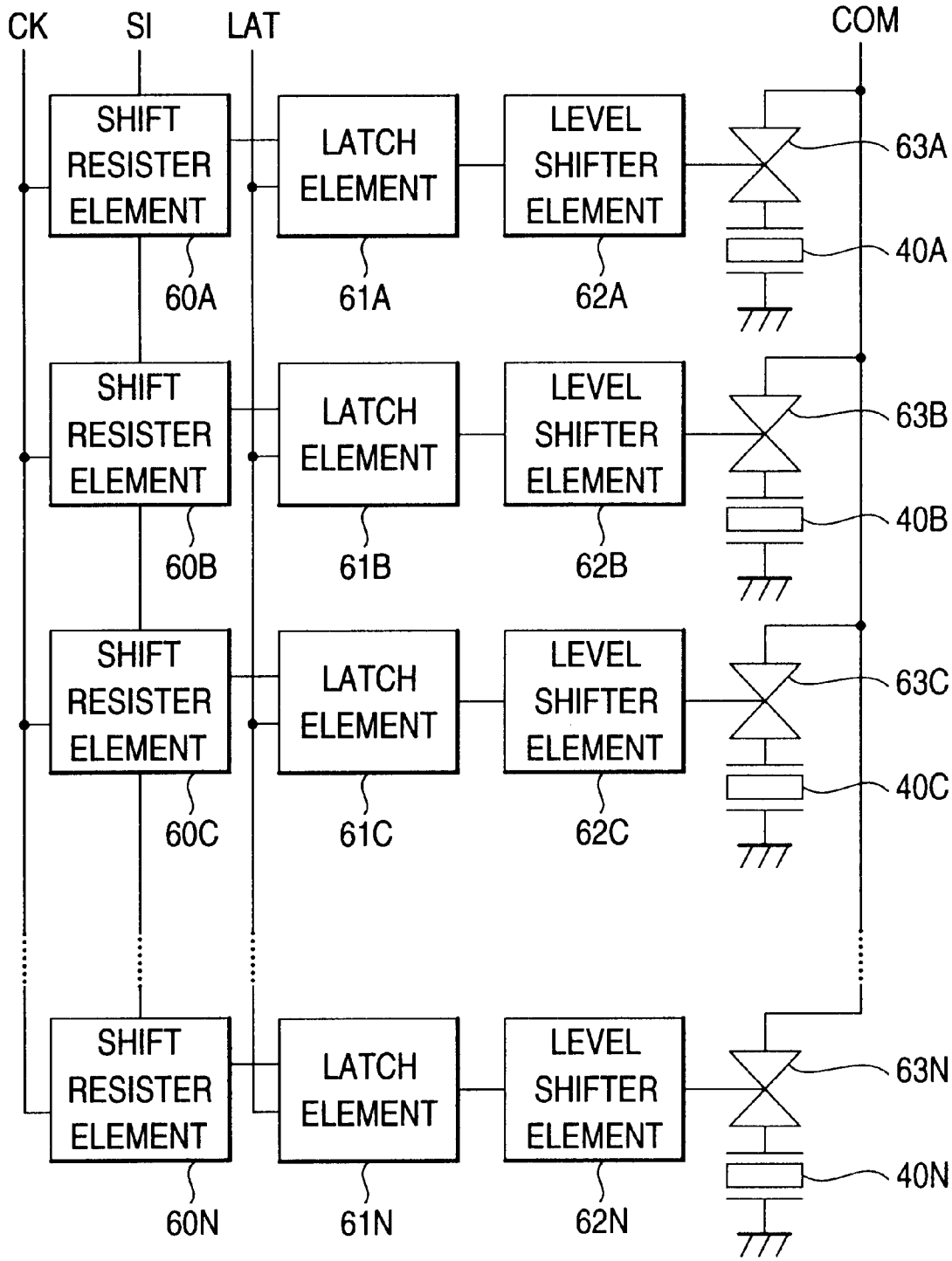
FIG. 6 is a block diagram showing the electric configuration of the recording head.

To jet ink drops through the recording head 8, as shown in FIG. 6, the control section 6 transmits print data (SI) in series from the output buffer 4C and sets the data in the shift register elements 60A to 60N in sequence in synchronization with a clock signal (CK) from the oscillator 7. If the print data as much as all nozzle orifices 50 is set in the shift register elements 60A to 60N, the control section 6 outputs a latch signal (LAT) to the latching circuit 61, namely, the latch elements 61A to 61N at a predetermined timing. According to the latch signal, the latch elements 61A to 61 N latch the print data set in the shift register elements 60A to 60N. The latched print data is supplied to the level shifter 62, a voltage amplifier, namely, the level shifter elements 62A to 62N.

For example, if the print data is "1," each level shifter element 62A–62N boosts the print data to a voltage value at which the switching circuit 63 can be driven, for example, several ten volts. The boosted print data is applied to the switching circuit 63, namely, the switch element 63A–63N, which then enters a connection state as the print data is applied. For example, the print data is "0," the corresponding level shifter element 62A–62N does not boost the print data. A drive signal (COM) from the drive signal generator 9 is applied to each switch element 63A–63N and when the switch element 63A–63N enters a connection state, the drive signal is supplied to the piezoelectric actuator 40A–40N connected to the switch element 63A–63N.

Thus, the drive signal is supplied to the piezoelectric actuator 40 corresponding to the nozzle orifice 50 with print data "1" set. Receiving the drive signal, the piezoelectric actuator 40 expands and contracts in the length direction of the actuator for expanding and contracting the cavity 51. As the cavity 51 is expanded and contracted, an ink drop is jetted through the nozzle orifice 50.

On the other hand, the drive signal is not supplied to the piezoelectric actuator 40 corresponding to the nozzle orifice 50 with print data "0" set, so that the volume of the cavity 51 is maintained in a steady state and an ink drop is not jetted.

Therefore, print data "1" is set for the nozzle orifice 50 for recording a dot and print data "0" is set for the nozzle orifice 50 for recording no dot, whereby whether or not an ink drop is to be jetted can be controlled for each nozzle orifice 50.

Figure 7:
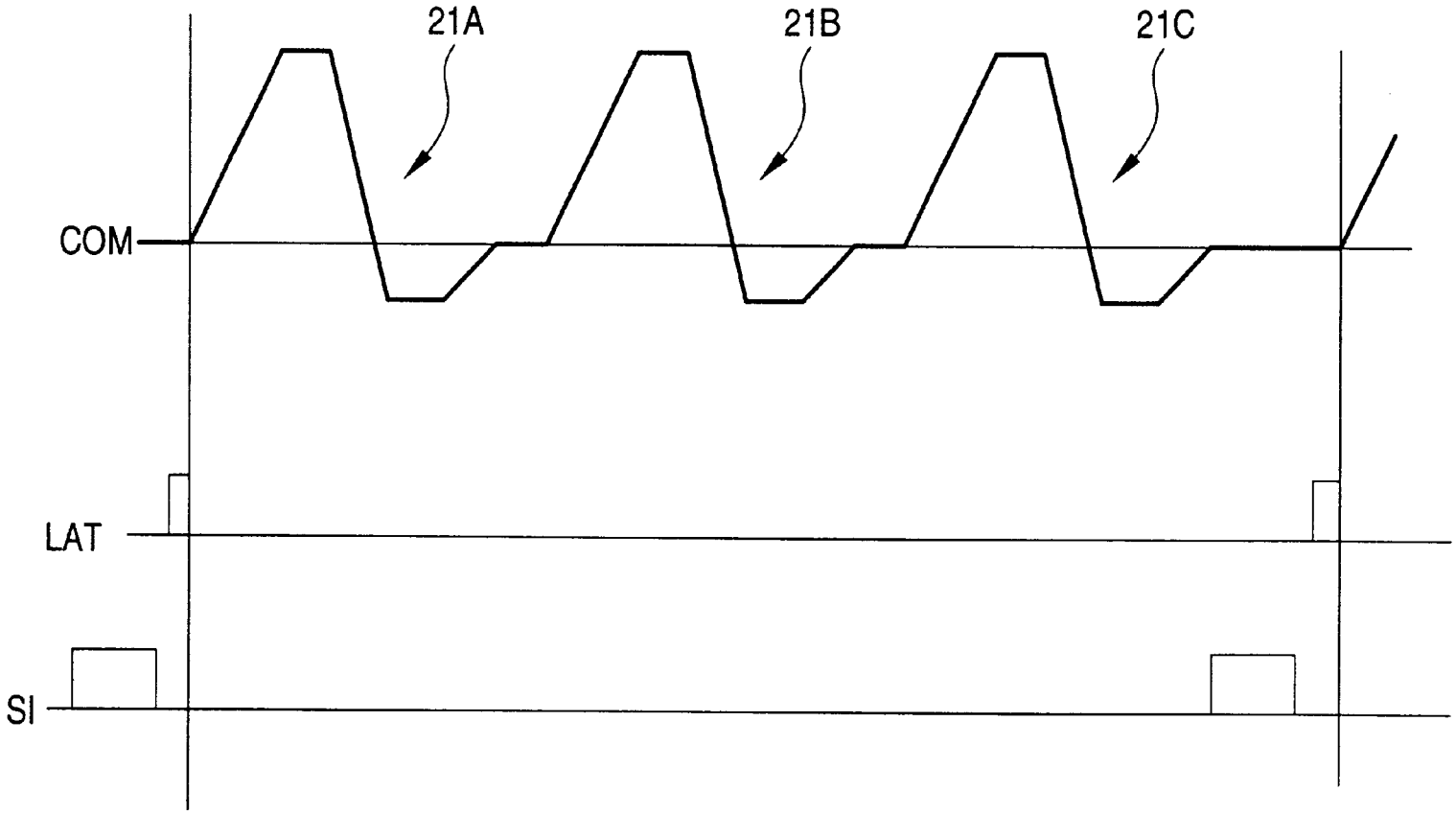
FIG. 7 is a diagram showing signals for driving the recording head.

Next, the above-mentioned drive signal will be discussed in detail. As shown in FIGS. 7 and 8, the drive signal in the embodiment is a signal comprising a first pulse 21A, a second pulse 21B, and a third pulse 21C connected in sequence. The first pulse 21A, the second pulse 21B, and the third pulse 21C are applied to the piezoelectric actuator 40, whereby three ink drops of the same weight are jetted successively through the nozzle orifice 50, forming a normal dot on record paper 27.

Since the first pulse 21A, the second pulse 21B, and the third pulse 21C are pulses of the same waveform, the first pulse 21A will be discussed.

The first pulse 21A consists of an expansion element 16 for increasing potential at a constant voltage gradient from intermediate potential Vm to expansion potential VPS for expanding the cavity 51 (pressure generating chamber) in the normal state, a first holding element 17 for holding the expansion potential VPS for maintaining the expansion state of the cavity 51, an ejection element 18 for decreasing potential at a constant voltage gradient from the expansion potential VPS to contraction potential VLS for contracting the cavity 51 in the expansion state, thereby jetting an ink drop, a second holding element (contraction holding element) 19 for holding the contraction potential VLS for maintaining the contraction state of the cavity 51, and a damping element 20 for increasing potential at a constant voltage gradient from the contraction potential VLS to the intermediate potential Vm for expanding the cavity 51 maintained in the contraction state by the second holding element 19 and restoring the cavity to the normal state.

When the expansion element 16 is applied to the piezoelectric actuator 40, the piezoelectric actuator 40 in the normal state is contracted in the length direction of the actuator for expanding the volume of the cavity 51. When applying the expansion element 16 is complete and the first holding element 17 is applied to the piezoelectric actuator 40, the contraction state of the piezoelectric actuator 40 is maintained the contraction state of the cavity 51 is also maintained accordingly. When applying the first holding element 17 is complete and the ejection element 18 is applied to the piezoelectric actuator 40, the piezoelectric actuator 40 in the contraction state is expanded rapidly in the length direction of the actuator, contracting the volume of the cavity 51. As the volume of the cavity 51 is contracted, ink pressure in the cavity 51 rises rapidly and an ink drop is jetted through the nozzle orifice 50. When the damping element 20 is applied after applying the ejection element 18 is complete and the second holding element 19 is applied, the piezoelectric actuator 40 in the expansion state is contracted in the length direction of the actuator and becomes the length in the normal state, whereby the cavity 51 in the contraction state is expanded and restored to the normal state. As the cavity 51 is expanded and restored to the normal state, the ink pressure in the cavity 51 is decompressed and vibration of a meniscus attempting to vibrate largely as the ejection element 8 is applied is reduced.

In the embodiment, the value resulting from adding the duration of the ejection element 18, pwd1, and the duration of the second holding element 19, pwh2, is matched with the natural period Tc of the cavity (pressure generating chamber) 51.

Both the duration of the ejection element 18, pwd1, and the duration of the damping element 20, pwc2, are matched with the natural period Ta of the piezoelectric actuator 40.

The reason why the value resulting from adding the duration of the ejection element 18, pwd1, and the duration of the second holding element 19, pwh2, is matched with the natural period Tc is as follows:

The piezoelectric actuator 40 contracted by applying the expansion element 16 and the first holding element 17 is expanded by applying the ejection element 18. As the piezoelectric actuator 40 is expanded, the cavity 51 in the expansion state is contracted rapidly and the meniscus largely vibrates accordingly. At this time, the vibration of the meniscus is largely affected by the contraction of the cavity 51 and thus the vibration cycle of the meniscus becomes the natural period of the cavity 51, Tc.

As the application of the ejection element 18 is started, large vibration based on the natural period Tc is started and the meniscus pulled into the cavity 51 by applying the expansion element 16 and the first holding element 17 moves toward the ink jet direction. The move direction of the meniscus vibrated on the natural period Tc is inverted after the expiration of time (Tc/2) since the move start of the meniscus in the ink jet direction, and the meniscus moves in the pull-in direction. Then, after the expiration of time Tc, the move direction of the meniscus is again inverted and the meniscus attempts to move in the ink jet direction.

Since the value resulting from adding the duration of the ejection element 18, pwd1, and the duration of the second holding element 19, pwh2, is matched with the natural period Tc, the damping element 20 is applied after the expiration of the time Tc since the application start of the ejection element 18. As the damping element 20 is applied, the piezoelectric actuator 40 is contracted and the cavity 51 is expanded, so that the pressure in the cavity 51 becomes negative, reducing the move force of the meniscus attempting to move in the ink jet direction. Therefore, the vibration of the meniscus is suppressed.

Thus, the value resulting from adding the duration of the ejection element 18, pwd1, and the duration of the second holding element 19, pwh2, is matched with the natural period Tc, whereby the vibration of the meniscus can be suppressed effectively.

Next, the reason why the duration of the ejection element 18, pwd1, and the duration of the damping element 20, pwc2, are matched with the natural period of the piezoelectric actuator 40, Ta, is as follows:

First, if the duration pwd1 and the duration pwc2 are made shorter than the natural period Ta, a phenomenon occurs in which expansion and contraction of the piezoelectric actuator 40 do not catch up with voltage change of the ejection element 18 and the damping element 20. That is, expansion and contraction of the piezoelectric actuator 40 do not follow voltage change of the ejection element 18 and the damping element 20. Thus, expansion and contraction of the piezoelectric actuator 40 become unstable and it becomes difficult to control expansion and contraction of the cavity 51. Resultantly, jetting an ink drop becomes unstable.

On the other hand, if the duration pwd1 is set longer than the natural period Ta, the ink drop jetting speed lowers or the ink drop amount becomes smaller than the normal amount. As the ink drop jetting speed lowers, the ink drop hit position shifts from the normal position, resulting in degradation of the quality of a record image. If the ink drop amount becomes smaller than the normal amount, degradation of the quality of a record image also results.

If the duration pwc2 is set longer than the natural period Ta, the expansion speed of the cavity 51 becomes low and the effect of damping weakens. Further, the time required for pulse signal is also prolonged and thus the time required for forming one dot is also prolonged, resulting in lowering of the record speed.

Thus, the duration pwd1 and the duration pwc2 are matched with the natural period Ta, whereby expansion and contraction of the piezoelectric actuator 40 can be controlled reliably, so that necessary ink drop jetting speed can be provided and the record speed can be maintained high.

By the way, the piezoelectric actuator 40, the channel unit 41, and the like are minute parts in mm units and are micromachined in mm units, thus characteristic variations occur from one recording head 8 to another.

For example, the length of the free end portion of the piezoelectric actuator 40 projecting from the overlapping end with the fixation substrate 45 varies from one recording head 8 to another because of an extremely small position shift at the joining time, causing the natural period Ta to differ. The natural period Tc varies from one recording head 8 to another because of dimension tolerances of the cavity 51 based on work accuracy or the like.

In the embodiment, such variations from one recording head 8 to another are corrected by changing the drive voltage VHN (potential difference between expansion potential VPS and contraction potential VLS), the duration of the ejection element 18, pwd1, the duration of the second holding element 19, pwh2, the duration of the damping element 20, pwc2, the potential difference between the contraction potential VLS and the intermediate potential Vm, VcN, in the drive waveform.

The variation correction will be discussed.

FIGS. 9A and 9B are tables describing a part of the waveform pattern information stored in the ROM 11 of the drive signal generator 9; FIG. 9A is a table describing the duration of the ejection element 18, pwd1 (ejection period information), and ID number (ejection period identifier) corresponding thereto and FIG. 9B is a table describing the duration of the second holding element 19, pwh2 (contraction holding period information), and ID number (contraction holding period identifier) corresponding thereto.

First, correction of the duration of the ejection element 18, pwd1, and the duration of the second holding element 19, pwh2, will be discussed with reference to FIGS. 9A and 9B.

In the embodiment, the duration of the ejection element 18, pwd1, can be set in 0.1 μs steps from 3.5 μs to 4.5 μs. ID number 0 is assigned to 4 μs (theoretical value) and ID number 1 is assigned to the shortest application period, 3.5 μs is. After this, the ID numbers are assigned in the ascending order of the application period; ID number B is assigned to the longest application period, 4.5 μs.

Likewise, the duration of the second holding element 19, pwh2, can be set in 0.2-μs steps from 3.1 μs to 6.1 μs. ID number 0 is assigned to 4.5 μs (theoretical value) and ID number 1 is assigned to the shortest application period, 3.1 μs. After this, the ID numbers are assigned in the ascending order of the application period; ID number 10 is assigned to the longest application period, 6.1 μs.

As described above, in the embodiment, the value resulting from adding the duration of the ejection element 18, pwd1, and the duration of the second holding element 19, pwh2, is matched with the natural period Tc of the cavity 51, and further the duration of the ejection element 18, pwd1, is matched with the natural period Ta of the piezoelectric actuator 40. The theoretical value of the natural period Tc is 8.5 is and that of the natural period Ta is 4 μs.

Therefore, for the recording head 8 with the measured natural period Ta and the measured natural period Tc as the theoretical values, the ID numbers corresponding to the first holding element 17 and the second holding element 19 are both set to 0 and are stored in the EEPROM 12 (ejection period identifier storage means and contraction holding period identifier storage means) of the drive signal generator 9. The drive signal generating section 13 (drive signal generator) makes a reference to the ID numbers stored in the EEPROM 12, sets the duration of the ejection element 18, pwd1, to 4 μs and the duration of the second holding element 19, pwh2, to 4.5 μs, and generates a drive signal (COM) with the addition value of the duration pwd1 and the duration pwh2 set to the theoretical value of the natural period Tc, 8.5 μs.

The natural period Ta is measured by using a laser displacement gauge to observe the vibration state of the piezoelectric actuator 40. It can also be measured by measuring a counter electromotive force occurring when voltage is applied to the piezoelectric actuator 40. The natural period Tc is measured by adding an input signal formed like a sine wave to the piezoelectric actuator 40 and observing the behavior of a meniscus on a nozzle orifice 50 at the time with a strobe scope for emitting light in synchronization with input. That is, the natural period Tc is measured by applying an input signal while changing frequency and checking that an ink meniscus vibrates largely with respect to a specific frequency. It can also be measured by observing the residual vibration of an ink meniscus after ink is jetted by normal drive.

On the other hand, if the measured natural period Ta is 4.2 μs shifting from the theoretical value and the measured natural period Tc is 8.5 μs exactly as the theoretical value, the ID number corresponding to the ejection element 18 is set to 8. The ID number of the second holding element 19 is set to 7 corresponding to the time 4.3 resulting from subtracting the measurement value of the natural period Ta, 4.2 μs, from the measurement value of the natural period Tc, 8.5 μs. The ID numbers are stored in the EEPROM 12 of the drive signal generator 9.

The drive signal generating section 13 makes a reference to the ID numbers stored in the EEPROM 12 and generates a drive signal with the duration of the ejection element 18, pwd1, to 4.2 μs and the duration of the second holding element 19, pwh2, to 4.3 μs.

Further, for the recording head 8 with the measured natural period Ta being 3.5 μs shifting largely from the theoretical value and the measured natural period Tc being also 9.5 μs shifting from the theoretical value, the ID number corresponding to the ejection element 18 is set to 1 and the ID number of the second holding element 19 is set to 10, whereby the drive signal of the optimum waveform can be supplied to the recording head 8.

Although there has been shown an example wherein the measured natural periods Ta and Tc are within a range shown in FIGS. 9A and 9B (namely, pwd1=3.5–4.5 μs; and pwh2= 3.1–6.1 μs), it is naturally possible to attain the present invention by suitably adjusting the tables shown FIGS. 9A and 9B even if the natural period value is out of the above range.

Thus, the addition value of the duration pwd1 and the duration pwh2 is matched with the natural period Tc of the cavity 51, whereby if the natural period Tc varies from one recording head 8 to another, an optimum drive signal for the natural period Tc can be given and vibration of a meniscus can be suppressed effectively. Further, the duration pwd1 is corrected matching the natural period Ta of the piezoelectric actuator 40, whereby if the natural period Ta varies, expansion and contraction of the piezoelectric actuator 40 can be controlled reliably.

Therefore, recording heads 8 formerly handled as defective items can be mounted as good items, the yields of the recording heads 8 can be furthermore enhanced, and reduction in costs of the recording head 8, and by extension of a printer can be accomplished.

Setting of the duration of the ejection element 18, pwd1, and the duration of the second holding element 19, pwh2, has been described, but a correction can also be made to other parameters, namely, the drive voltage VHN, the duration of the damping element 20, pwc2, and the potential difference between the contraction potential and the intermediate potential, VcN, in the drive waveform in a similar manner.

For example, for the duration of the damping element 20, pwc2, like the duration of the ejection element 18, pwd1, the ID number (damping period identifier) is set and the duration pwc2 is matched with the natural period Ta of the piezoelectric actuator 40. The duration of the damping element 20, pwc2, is matched with the natural period Ta, whereby if the natural period Ta varies from one recording head 8 to another, expansion and contraction of the piezoelectric actuator 40 can be controlled reliably at the damping period of a meniscus. Thus, the allowable range of the recording heads 8 that can be mounted on products as good items can be widened and the yields of the recording heads 8 can be furthermore enhanced.

For the drive voltage VHN, a drive signal (first pulse 21A, second pulse 21B. and third pulse 21C) is applied to the piezoelectric actuator 40 while the drive voltage is changed at reference temperature (for example, 25° C.), and the weight of the ink drop jetted by applying the drive signal is measured. The voltage value at which the measured ink drop amount matches the reference ink drop amount (for example, 40 ng) is set according to ID number (drive voltage identifier).

Since the drive voltage VHN can be thus changed, the ink drop amounts varying from one recording head 8 to another can be made constant.

In the embodiment, the potential difference between the contraction potential and the intermediate potential, VcN, is based on the drive voltage VHN, namely, the voltage value of a predetermined percentage of the drive voltage VHN is adopted as the potential difference VcN. Therefore, information of the potential difference VcN (damping voltage information) is a percentage to the drive voltage VHN. For example, the theoretical value is set to 25% of the drive voltage (namely, VcN=25) and ID number 0 is assigned to the value 25. The percentages to the drive voltage VHN are stored in the ROM 11 in 1% steps so that they can be changed in the range of 15% to 50%, and different ID numbers are assigned corresponding to the percentages.

An ink drop is jetted while the potential difference VcN is changed, and the residual vibration of a ink meniscus after ink is jetted is observed, whereby the damping state of the meniscus is observed. The ID number of the potential difference VcN providing the highest damping effect (damping voltage identifier) is stored in the EEPROM 12.

If the potential difference between the contraction potential and the intermediate potential, VcN (potential difference between the potential at the start of application of the damping element 20 and the potential at the end of application thereof), can be thus changed in response to attenuation of the vibration of a meniscus, the expansion degree of the cavity 51 as the damping element 20 is applied can be adjusted. That is, the potential difference VcN is made larger than the reference potential difference VcN, whereby the expansion degree of the cavity 51 can be made larger than the reference expansion rate; if the potential difference VcN is made smaller than the reference potential difference VcN, the expansion degree of the cavity 51 can be made smaller than the reference expansion rate.

Therefore, for the recording head 8 with a meniscus vibrating more largely than a meniscus in the reference recording head 8 just after an ink drop is jetted, the potential difference VcN is set larger than the reference potential difference VcN for increasing the expansion rate of the cavity 51; whereas, for the recording head 8 with smaller vibration of a meniscus than that in the reference recording head 8, the potential difference VcN is set smaller than the reference potential difference VcN for decreasing the expansion rate of the cavity 51, whereby the meniscus vibration state in one recording head 8 can be matched with that in another.

Thus, even for the recording head 8 having a characteristic such that a meniscus largely vibrates just after an ink drop is jetted, the meniscus vibration can be suppressed in a short time. Therefore, even such a recording head 8 can be caused to stably perform the jet operation based on the next drive pulse (for example, the second pulse 21B), and the allowable range of the recording heads 8 that can be mounted on products as good items can be further widened.

Thus, the printer of the embodiment is configured so that the parameters of the drive voltage VHN, the duration of the ejection element 18, pwd1, the duration of the second holding element 19, pwh2, the duration of the damping element 20, pwc2, and the potential difference between the contraction potential and the intermediate potential, VcN, can be changed for the drive signal (COM) applied to the recording head 8, so that the ink drop jetting characteristic varying from one recording head 8 to another can be corrected and can be made constant.

Since the duration of the ejection element 18, pwd1, the duration of the second holding element 19, pwh2, the duration of the damping element 20, pwc2, and the potential difference between the contraction potential and the intermediate potential, VcN, can also be changed, the recording heads 8 handled as defective items in the correction of changing only the drive voltage VHN in the related art can also be mounted on products as good items and the yields of the recording heads 8 can be furthermore enhanced.

Accordingly, not only the recording head 8 but also the printer can be manufactured with low cost.

Further, in the embodiment, for the parameters of the drive voltage VHN, the duration of the ejection element 18, pwd1, the duration of the second holding element 19, pwh2, the duration of the damping element 20, pwc2, and the potential difference between the contraction potential and the intermediate potential, VcN, a plurality of values (information pieces) are stored in the ROM 11 in a one-to-one correspondence with the ID numbers and based on the ID number of each recording head 8 set in the EEPROM 12, a value appropriate for the print head 8 is selected, so that the optimum drive signal can be applied to the piezoelectric actuator 40 simply by storing the ID number in the EEPROM 12 at the time of final adjustment before the shipment. Thus, correction work for each recording head 8 can be facilitated.

The drive signal described above may be generated by the pulse width modulation method or the programmable drive signal generating method as disclosed in Japanese Patent No. 2940542. Of course, the method to generate the drive signal is not limited the above.

In the above embodiment, although the description has been given with respect to the ink jet recording apparatus as the actuator device, the present invention is not limited to the embodiment. For example, a drive signal in which information of a natural period of an energy generating part constituting an actuator device is reflected may be formed programmably, and the drive signal may be applied to the actuator device for preferable driving. Even an actuator which is originally out of standard according to the variation of the natural period can be made available by means of the drive signal according to the present invention. Therefore, the available percentage of the actuator devices can be increased.

As examples of an actuator device to which the present invention can be applied, a piezoelectric fan, a VTR head, an ultrasonic motor, an impact printer head, or the like. Detailed discussion is disclosed in "The Application of Piezoelectric Ceramics" published by Gakukensha (1989) and is thus omitted herein.

The present invention may cover a recording medium for storing a program for causing a computer system to generate such a drive signal including the waveform elements described above.

Furthermore, if the respective waveform elements are realized by a program such as an operation system running on a computer system, the present invention may also cover a recording medium for storing a program for causing a computer system to operate a program such as an operation system, In the embodiment, the piezoelectric actuator 40 formed of the actuator like comb teeth in so-called vertical vibration mode comprising the piezoelectric body 42 and the internal electrodes 43 and 44 deposited in the direction orthogonal to the expansion and contraction direction of the actuator is taken as an example. However, the invention can also be applied to a piezoelectric actuator 40 in so-called deflection vibration mode comprising the piezoelectric body 42 and the internal electrodes 43 and 44 deposited in the expansion and contraction direction of the actuator.

As has been described heretofore, according to the present invention, even though the actuator devices are provided with characteristic variations, the drive signal for operating the actuator device can be flexibly set in accordance with the characteristic variation. Therefore, the actuator device can be always operated with an optimum drive signal. Further, the yields of the recording head can be improved.

The above description, natural period means a period associated with an around dominant frequency of one of or various kind of components of the actuator, such as dominant frequency of piezoelectric actuator, and including around integer fractions or multiples (subharmonics or harmonics) thereof.

What is claimed is:

1. An ink jet recording apparatus comprising:

a recording head including a piezoelectric actuator for varying the volume of a pressure generating chamber by the deformation thereof to eject an ink drop from a nozzle communicating with the pressure generating chamber;

a drive signal generator for generating a drive signal, said drive signal including, an expansion potential for deforming the piezoelectric actuator so as to expand the pressure generating chamber;

a contraction potential for deforming the piezoelectric actuator so as to contract the pressure generating chamber;

an ejection element for varying a potential of the drive signal from the expansion potential to the contraction potential to eject the ink drop from the nozzle; and a contraction holding element for holding the contraction potential to keep the contracted state of the pressure generating chamber, said generator comprises, an ejection period information storage for storing a plurality of values of a duration of the ejection element; and a contraction holding period information storage for storing a plurality of values of a duration of the contraction holding element, wherein the drive signal generator selects one duration of the ejection element and one duration of the contraction holding element respectively from the ejection period information storage and the contraction holding information storage such that the duration of the ejection element is matched with a natural period of the piezoelectric actuator, and a resulting value obtained by adding the duration of the ejection element and the duration of the contraction holding element is matched with a natural period of the pressure generating chamber.

2. The ink jet recording apparatus as set forth in claim 1, further comprising:

an ejection period identifier storage for storing ejection period identifiers each of which is associated with the respective values stored in the ejection period information storage; and a contraction holding period identifier storage for storing contraction holding period identifiers each of which is associated with the respective values stored in the contraction holding period information storage, wherein the drive signal generator refers to the ejection period identifier and the contraction holding period identifier to determine the application periods of the ejection element and the contraction holding element.

3. The ink jet recording apparatus as set forth in claim 1, wherein the drive signal includes a variable intermediate potential which is between the expansion potential and the contraction potential, and a damping element for varying the potential of the drive signal from the contraction potential to the intermediate potential for restoring the contracted pressure generating chamber to an initial state, and wherein the drive signal generator determines a duration of the damping element so as to match with the natural period of the piezoelectric actuator.

4. The ink jet recording apparatus as set forth in claim 3, further comprising:

an intermediate potential information storage for storing a plurality values of the intermediate potential, wherein the drive signal generator selects one potential value from the intermediate potential information storage in accordance with jetting amount of the ink drop.

5. The ink jet recording apparatus as set forth in claim 4, further comprising:

an intermediate potential identifier storage for storing intermediate potential identifiers each of which is associated with the respective values stored in the intermediate potential information storage, wherein the drive signal generator refers to the intermediate potential identifier to determine the value of the intermediate potential.

6. The ink jet recording apparatus as set forth in claim 1, wherein the drive signal is so arranged as to eject a plurality of ink drops having the same weight successively within the same driving period.

7. An ink jet recording apparatus comprising:

a recording head including a piezoetectric actuator for varying the volume of a pressure generating chamber by the deformation thereof to eject an ink drop from a nozzle communicating with the pressure generating chamber; and a drive signal generator for generating a drive signal, said drive signal including, an expansion potential for deforming the piezoelectric actuator so as to expand the pressure generating chamber;

a contraction potential for deforming the piezoelectric actuator so as to contract the pressure generating chamber;

an intermediate potential which is between the expansion potential and the contraction potential;

an ejection element for varying a potential of the drive signal from the expansion potential to the contraction potential to eject the ink drop from the nozzle;

a contraction holding element for holding the contraction potential to keep the contracted state of the pressure generating chamber; and a damping element for varying the potential of the drive signal from the contraction potential to the intermediate potential for restoring the contracted pressure generating chamber to an initial state; and said generator comprises, a characteristic information storage for storing characteristic information of the recording head which is referred by the drive signal generator and reflected to at least one of the expansion potential, the contraction potential, the intermediate potential, the ejection element, the contraction holding element and the damping element to generate the drive signal.

8. The ink jet recording apparatus as set forth in claim 7, wherein the characteristic information includes at least one of a natural period of the piezoelectric actuator, a natural period of the pressure generating chamber and a natural period of meniscus of ink in the nozzle.

9. The ink jet recording apparatus as set forth in any one of claims 1 to 8, wherein the respective potentials and the respective elements in the drive signal is programmably defined.

10. An actuator device comprising:

an actuator;

a drive signal generator for generating a drive signal driving the actuator and including:

an expansion potential for expanding the actuator;

an expansion holding element for holding the expansion potential to keep the expanded state of the actuator;

a contraction potential for contracting the actuator; and a contraction holding element for holding the contraction potential to keep the contracted state of the actuator; and a characteristic information storage for storing characteristic information of the actuator which is referred by the drive signal generator and reflected to at least one of the expansion potential, a duration period of the expansion holding element, the contraction potential and a duration period of the contraction holding potential to generate the drive signal.

11. The actuator device as set forth in claim 10, wherein the drive signal is composed of a plurality of waveform elements, and the characteristic information is reflected to at least one of the waveform elements.

12. The actuator device as set forth in claim 10 or 11 wherein the characteristic information includes a natural period of constituent elements of the actuator device.

13. The actuator device as set forth in claim 10 or 11, wherein the characteristic information includes a natural period of constituent elements of the actuator.

14. The actuator device as set forth in claim 10 or 11, wherein the chacteristic information includes a natural period of the actuator.

15. A recording medium for storing a program for driving the actuator device as set forth in claim 10, which is executed by a computer system including at least one computer.

16. A recording medium for storing a program for driving the ink jet recording apparatus as set forth in claim 1 or 7, which is executed by a computer system including at least one computer.

* * * * *

UNITED STATES PATENT AND TRADEMARK OFFICE

CERTIFICATE OF CORRECTION

PATENT NO. : 6,485,133 B1
APPLICATION NO. : 09/494420
DATED : November 26, 2002
INVENTOR(S) : Hirofumi Teramae and Satoru Hosono It is certified that error appears in the above-identified patent and that said Letters Patent is hereby corrected as shown below:

On the title page, item [75] should read.

Inventors: Hirofumi TERAMAE; Satoru HOSONO; Yuichi NAKAMURA, ~~both~~ all three of Nagano (JP)

Signed and Sealed this

Eleventh Day of September, 2007

JON W. DUDAS
*Director of the United States Patent and Trademark Office*